US009521902B2

(12) United States Patent
Villalobos

(10) Patent No.: US 9,521,902 B2
(45) Date of Patent: Dec. 20, 2016

(54) SHOE CAROUSEL DEVICE

(71) Applicant: Sandra Huizar Villalobos, San Antonio, TX (US)

(72) Inventor: Sandra Huizar Villalobos, San Antonio, TX (US)

( * ) Notice: Subject to any disclaimer, the term of this patent is extended or adjusted under 35 U.S.C. 154(b) by 0 days.

(21) Appl. No.: 14/584,854

(22) Filed: Dec. 29, 2014

(65) Prior Publication Data

US 2015/0245710 A1 Sep. 3, 2015

Related U.S. Application Data

(63) Continuation-in-part of application No. 13/753,641, filed on Jan. 30, 2013, now Pat. No. 8,919,578.

(51) Int. Cl.

| | |
|---|---|
| ***A47F 7/08*** | (2006.01) |
| ***A47B 61/04*** | (2006.01) |
| ***A47B 49/00*** | (2006.01) |
| ***A47B 96/14*** | (2006.01) |
| ***F21V 33/00*** | (2006.01) |
| ***A47F 5/025*** | (2006.01) |
| ***A47F 5/04*** | (2006.01) |

(52) U.S. Cl.

CPC ..... *A47B 61/04* (2013.01); *A47B 49/004* (2013.01); *A47B 49/008* (2013.01); *A47B 96/1425* (2013.01); *A47F 5/025* (2013.01); *A47F 5/04* (2013.01); *A47F 7/08* (2013.01); *F21V 33/0024* (2013.01)

(58) Field of Classification Search

CPC ..... A47B 61/04; A47B 49/004; A47B 49/008; A47B 47/0091; A47B 49/00; A47B 49/003; A47B 13/083; A47B 13/08; A47B 95/043; A47B 96/1425; A47F 5/04; A47F 5/025; A47F 7/08;A47F 5/02; A47F 3/10; A47F 5/05; A47F 5/06; A47F 3/11; A47F 3/08; A47G 25/005; A47G 25/54; E05B 69/003; A47L 23/00; A47L 23/16; B25H 3/04; F21V 33/002; F21V 33/0024; F21V 33/0028; F21Y 2103/02; F21Y 2103/022; F21Y 2103/025; F21Y 2101/02; F21Y 2103/003

USPC ..... 211/36, 196, 205, 34, 37, 144, 163, 211/129.1, 131.1, 133.4, 70, 56, 58, 1.51, 211/1.52, 180, 13.1; 108/103, 27, 139; 312/125, 135, 312/305; 206/278; 362/122, 362/127, 132, 154, 234, 362/249.02

See application file for complete search history.

(56) References Cited

U.S. PATENT DOCUMENTS

| | | | | |
|---|---|---|---|---|
| 2,082,088 A * | 6/1937 | Wilson | A47B 61/04 | 211/113 |
| 2,613,735 A * | 10/1952 | Fisher | A47C 7/62 | 211/36 |
| 2,973,867 A * | 3/1961 | Cohen | A47F 5/02 | 211/144 |
| 3,437,214 A * | 4/1969 | Sainsbury | A47B 96/067 | 108/152 |

(Continued)

*Primary Examiner* — Jennifer E Novosad

(74) *Attorney, Agent, or Firm* — The Keys Law Firm PLLC

(57) ABSTRACT

A shoe carousel device that includes in one embodiment a base for stabilization and support, a support stem attached to the base and extending upwards therefrom at an approximate 90 degree angle, and a plurality of stackable shelves mounted on the support stem, including a discrete top shelf. The stackable shelves and top shelf are circular shaped with a raised outer tab and lighting disposed along their circumference and a relatively thin mesh surfacing. In some embodiments, the shoe carousel device also includes a foot pedal actuated motor operative to rotate the shoe carousel device.

8 Claims, 7 Drawing Sheets

(56) References Cited

U.S. PATENT DOCUMENTS 3,468,039 A * 9/1969 Dubbert ..... A47B 97/04 108/166
3,833,128 A * 9/1974 Sumner ..... A47F 5/0031 211/131.1
4,036,367 A * 7/1977 Stambaugh ..... A47F 7/08 211/163
4,858,772 A * 8/1989 Phillipson ..... A47B 49/00 211/115
5,033,626 A * 7/1991 Platti ..... A47B 49/004 211/163
5,050,746 A * 9/1991 Frankel ..... A47F 7/08 211/163
5,127,528 A * 7/1992 Cone ..... A47B 96/1425 211/163
5,318,175 A * 6/1994 Stevens ..... A47G 25/0664 211/107
5,785,185 A * 7/1998 Klebba ..... A47F 7/08 211/163
5,813,547 A * 9/1998 Rice ..... A47F 7/08 211/122
5,984,114 A * 11/1999 Frankel ..... A47F 7/08 211/131.1
6,086,171 A * 7/2000 Ashley ..... A47B 49/00 211/163
6,464,086 B1 * 10/2002 Klein ..... A47B 96/16 211/35
6,502,707 B1 * 1/2003 Sullivan ..... A47F 7/08 211/144
6,631,804 B2 * 10/2003 Wong ..... A47F 5/02 206/501
6,837,386 B1 * 1/2005 Kent ..... A47B 96/027 108/151
7,523,833 B2 * 4/2009 Zipeto ..... A47B 49/00 211/144
7,584,973 B2 * 9/2009 Brager ..... B25H 3/026 108/141
8,567,984 B1 * 10/2013 Tierney ..... A47B 97/00 362/127
8,919,578 B2 * 12/2014 Villalobos ..... A47F 7/08 211/144
2002/0162815 A1 * 11/2002 Wang ..... A47B 43/003 211/194
2003/0230502 A1 * 12/2003 Siegel ..... A47B 43/00 206/286
2004/0200392 A1 * 10/2004 Poo ..... A47B 13/08 108/161
2005/0117339 A1 * 6/2005 Pan ..... A47F 11/10 362/249.01
2005/0224428 A1 * 10/2005 Weber ..... A47F 7/08 211/36
2006/0181180 A1 * 8/2006 McCabe ..... A47F 3/001 312/114
2009/0230069 A1 * 9/2009 Naden ..... A47B 49/004 211/144
2011/0188250 A1 * 8/2011 Waldhuetter ..... F21S 4/007 362/249.05
2014/0209547 A1 * 7/2014 Villalobos ..... A47F 7/08 211/36
2015/0245710 A1 * 9/2015 Villalobos ..... A47F 5/025 211/1.55

* cited by examiner

SHOE CAROUSEL DEVICE

CROSS REFERENCE TO RELATED APPLICATIONS

This application is a continuation in part of, claims the benefit of, and incorporates by reference co-pending U.S. patent application Ser. No. 13/753,641, filed Jan. 30, 2013.

BACKGROUND OF THE INVENTION

Field of the Invention

This invention relates generally to support racks and, more particularly, to a plural level support rack that holds shoes in a display position while being stored.

Description of the Prior Art

The use of and design of conventional storage racks for shoes is well known. A problem which still exists, however, is that conventional shoe storage racks do not hold the shoes being stored thereon in an orientation which enables a user to easily observe and distinguish them. Indeed, not only are conventional racks often low to the ground, they take up a substantial amount of floor space relative to the number of shoes they can hold. Furthermore, the conventional shoe rack which intended to provide relatively quick and easy access to the shoes in a shoe collection often become overcrowded, leading to scuff marks and accumulate dust damaging the shoes. Thus, there remains a need for a shoe carousel device that is relatively narrower than a traditional shoe carousel device and conserves space. It would be helpful if such a shoe carousel device was configured to rotate manually about a fixed, mounting stem. It would be additionally desirable for such a shoe carousel device to have a distinct shelving styles, enabling both flat bottom and high heel shoes to be held at an angle.

The Applicant's invention described herein provides for a shoe carousel device structured to hold shoes on a plurality of discrete racks in an angled position that maximizes the visibility of each shoe. The primary components of Applicant's shoe carousel device are a carousel base, a mounting stem, and a plurality of stackable shelves. When in operation, the shoe carousel device provides a relatively narrow body holding a plurality of rack that hold shoes radially in an angled orientation relative to a fixed center axis. As a result, many of the limitations imposed by the prior art structures are removed.

SUMMARY OF THE INVENTION

In one embodiment, the shoe carousel device is a rotating stand for heels, sandals and sneakers that is constructed of wood and mesh, plastic and mesh or metal and mesh and may accommodate approximately two to eight levels of shoe holders or stackable shelves. A raised outer rim that matches the base of the shoe carousel device is lined with felt to prevent shoes from scuffs and from falling off of the shoe carousel device resulting in scratches on shoes. An optional motor with a foot pedal provides power to rotate the shoe carousel device hands-free.

DETAILED DESCRIPTION OF THE INVENTION

Figure 1:
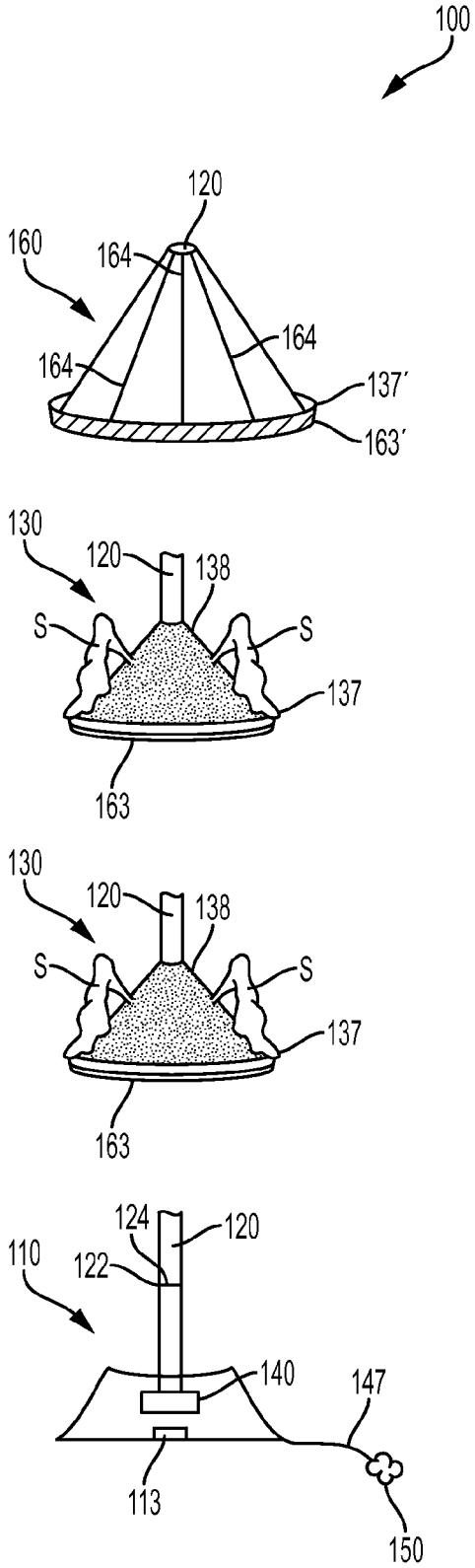
FIG. 1 is an exploded front elevational view of an electrical shoe carousel device built in accordance with a first embodiment of the present invention.
Figure 2:
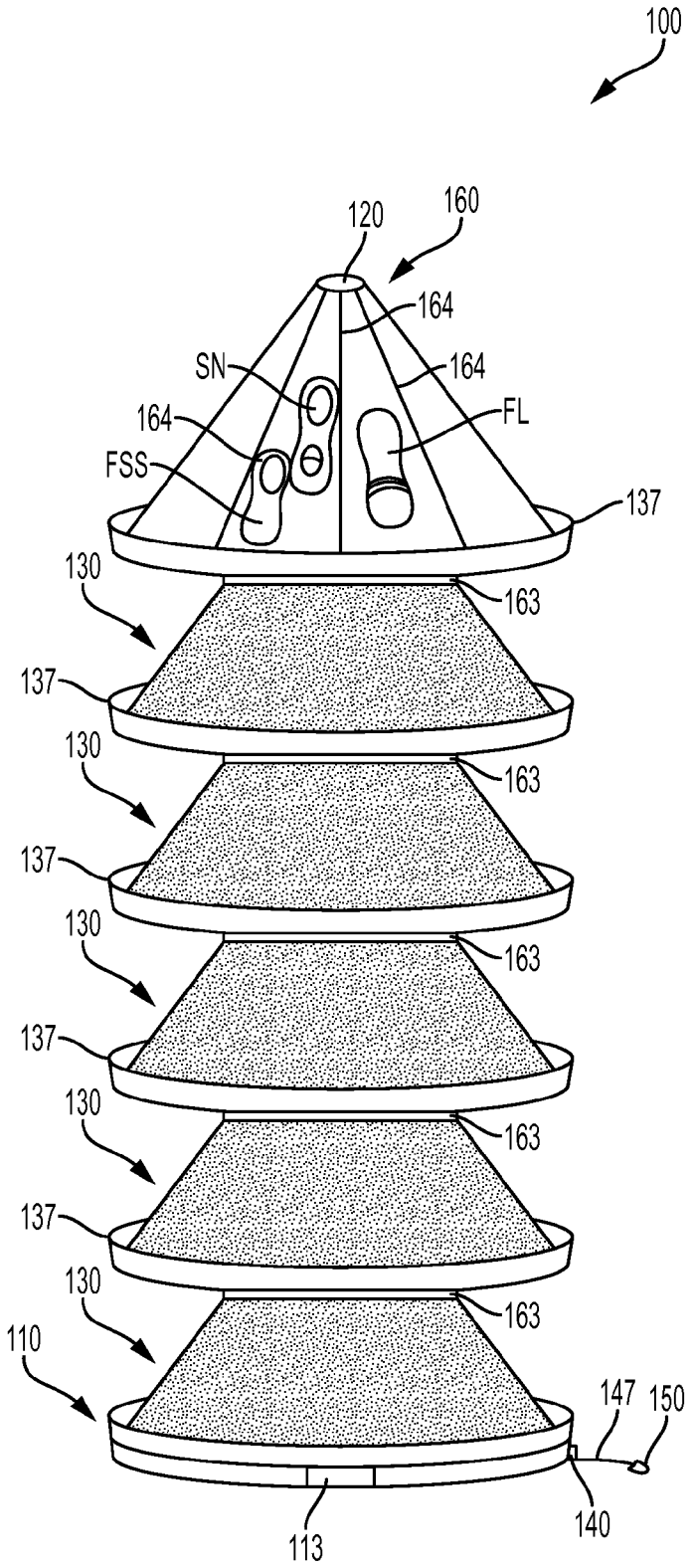
FIG. 2 is a front elevational view of an electrical shoe carousel device built in accordance with a first embodiment of the present invention.
Figure 3:
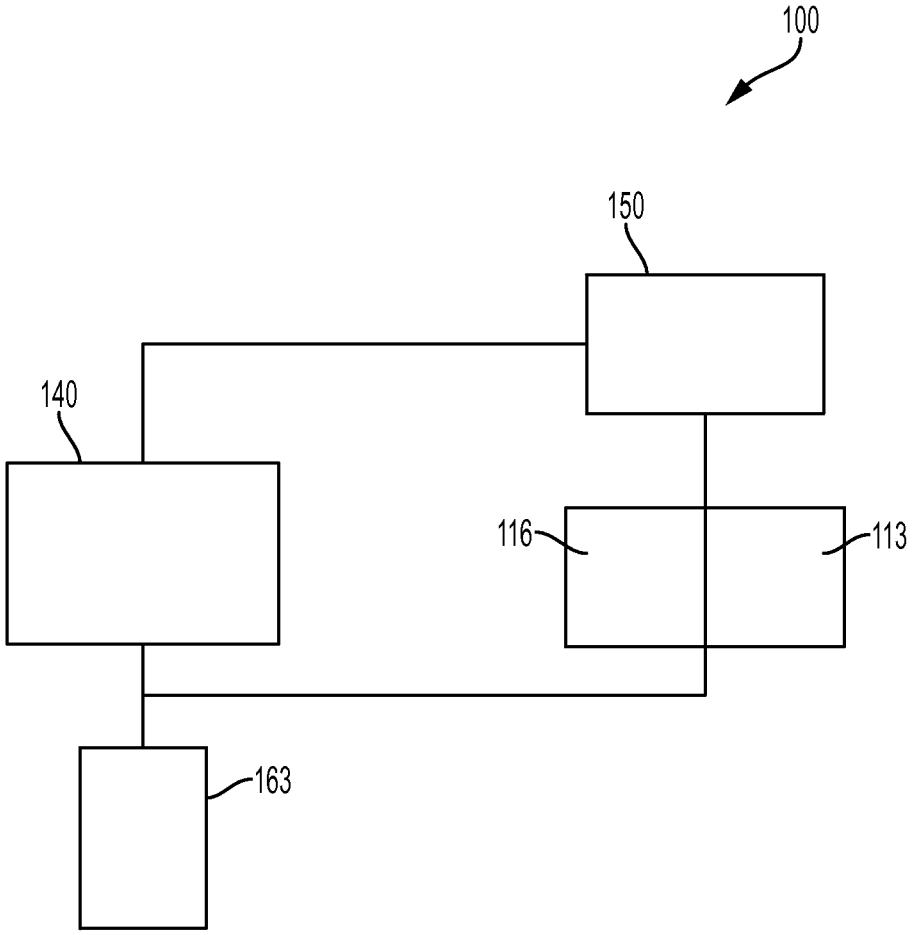
FIG. 3 shows an electrical diagram of an electrical shoe carousel device built in accordance with a first embodiment of the present invention.

Referring now to the drawings and in particular FIGS. 1, 2, and 3, a shoe carousel device 100 includes a base 110, a support stem 120 and a plurality of stackable shelves 130. The base 110 has a top and a bottom and stabilizes and supports the shoe carousel device 100. The top of the base 110 is rounded and the bottom of the base 110 has a flat slip-resistant surface to prevent the base 110 from sliding. The base 110 also includes a battery casing 113. The battery casing 113 houses one or more batteries (not shown), thereby providing an electrical power source. The support stem 120 has a bottom end 122 and is attached at an approximate 90 degree angle to the top of the base 110, extending upward therefrom. The attachment of the support stem 120 and the base 110 is reinforced by a support ring 124.

In the illustrated embodiment, the support stem 120 is made of metal. In other embodiments, the support stem 120 may be made of any suitable material, such as plastic or wood.

Each of the stackable shelves 130 include a raised outer rim 137 and top surfacing defined as a mesh surfacing 138. When in place on the support stem 120, each of the stackable shelves 130 are spaced between 8 inches to 9 inches apart. It is contemplated, however, that in other embodiments, the stackable shelves 130 can be arranged other distances apart. The shoe carousel device 100 is shown with 2 stackable shelves 130; it is contemplated, however, that a shoe carousel device 100 in accordance with the present invention may be configured with anywhere between 2 to 8 stackable shelves 130.

The raised outer rim 137 disposed along the circumference of each of the stackable shelves 130 prevents angularly placed shoes S from sliding off the stackable shelf 130, thereby facilitating keeping shoes S on the stackable shelf 130. In the preferred embodiment, the raised outer rim 137 is provided with felt disposed thereon protect the shoes S from scuffs. The mesh surfacing 138 covers the top surface of the stackable shelves 130, providing a textured surface that also assists in prevents angularly placed shoes S from sliding off the stackable shelf 130. In the illustrated embodiment, the stackable shelves 130 are tilted at an angle in the range of 220 degrees to 225 degrees relative to the support stem 120. In alternate embodiments, however, the stackable shelves 130 can be tilted at any suitable angle.

The shoe carousel device 100 includes a top shelf 160 that has a top surface defined by a plurality of angled slats 164 and has a raised outer lip 137' that operates in substantially the same manner as the raised outer rim 137 on the stackable shelves 130. The stackable shelves 130 and the top shelf 160 each include an elongated rope light 163 disposed underneath their respective outer rim 137 and outer lip 137', respectively to provide lighting to the shoes S below.

The shoe carousel device 100 also includes an electrical powered motor 140 and a foot pedal 150. The motor 140 is operative to rotate the shoe carousel device 100. The foot pedal 150 is attached to the motor 140 by an electrical cord 147 and when depressed activates the motor 140, causing it to rotate the support stem 110 of the shoe carousel device 100 as well as activating the elongated rope lights 163. It is contemplated that in this embodiment, the stackable shelves 130 and top shelf 160 are fixedly attached to the support stem 120 when mounted thereon such that when the support stem 120 rotates, the stackable shelves 130 and top shelf 160 rotate with it.

Significantly, the angled slats 264 disposed on the top shelf 260 configure the top shelf to keep flat soled shoes FSS, such as sandals SN, flats FL or other flat soled shoes, on the top shelf 260.

An electrical diagram of a shoe carousel device 100 shows the foot pedal 150 configured to selectively provide electricity to the motor 110 and the rope lights 163. The power source, defining the electricity selectively provided by the foot pedal 150, may be from an electrically connected electrical plug 116 that can be inserted into an electrical outlet or from batteries in the battery casing 113. When the foot pedal 150 is actuated, it operates as a momentary switch that completes a circuit that allows electricity from the power source to flow to the motor 110 and the rope lights 163.

Figure 4:
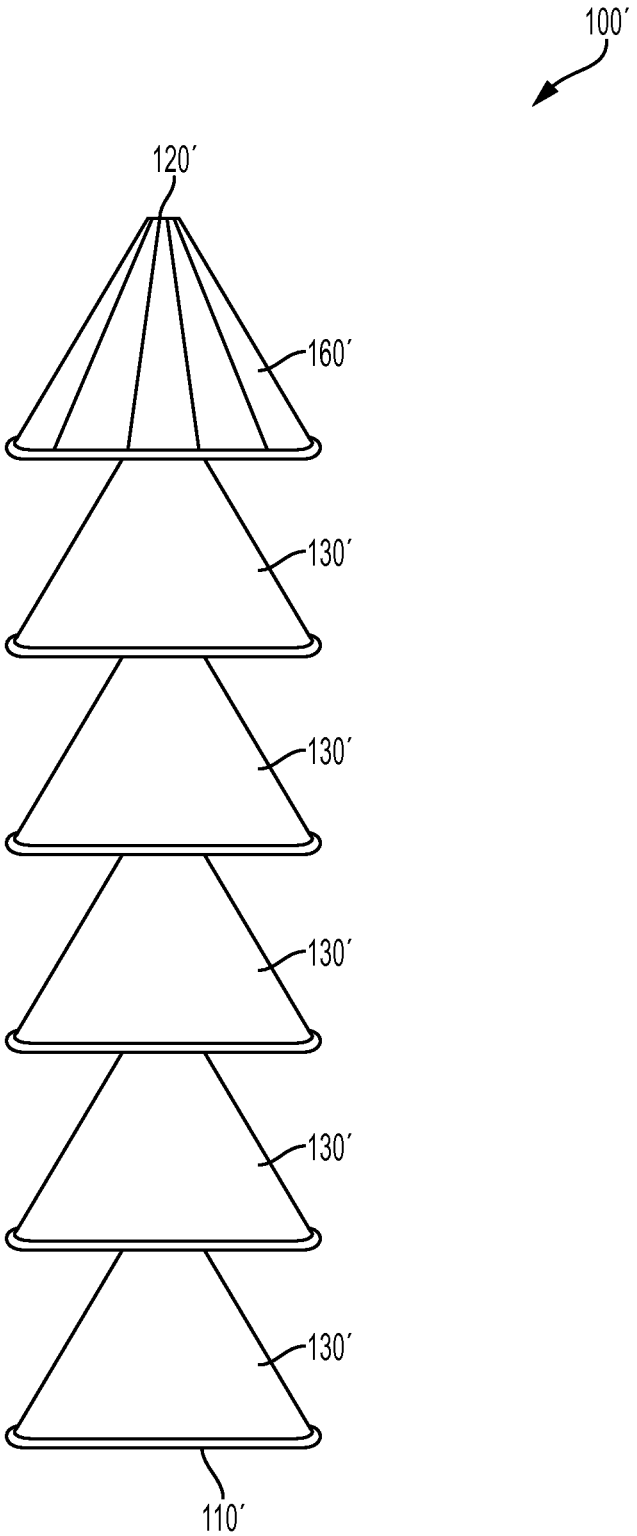
FIG. 4 shows a front elevational view of a manual shoe carousel device built in accordance with a first embodiment of the present invention.

Referring now to FIG. 4, a manual version of a shoe carousel device 100' includes substantially the same structural components of the electrical version of the shoe carousel device, including a base 110', a support stem 120', a plurality of stackable shelves 130', and a top shelf 160'. In the manual version, however, the electrical components, namely the motor, battery compartment, and foot pedal, are not present. Accordingly, the stackable shelves 130' and top shelf 160' are rotated through manual pressure. It is contemplated that in this embodiment, the stackable shelves 130' and top shelf 160' are mounted on the support stem 120' such that they spin freely.

Figure 5A:
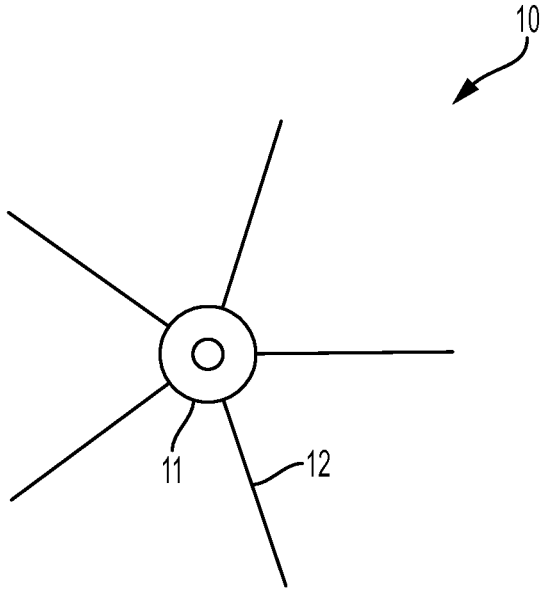
FIG. 5A shows a top plan view of a five leg embodiment of the base of a shoe carousel device built in accordance with a first embodiment of the present invention.
Figure 5B:
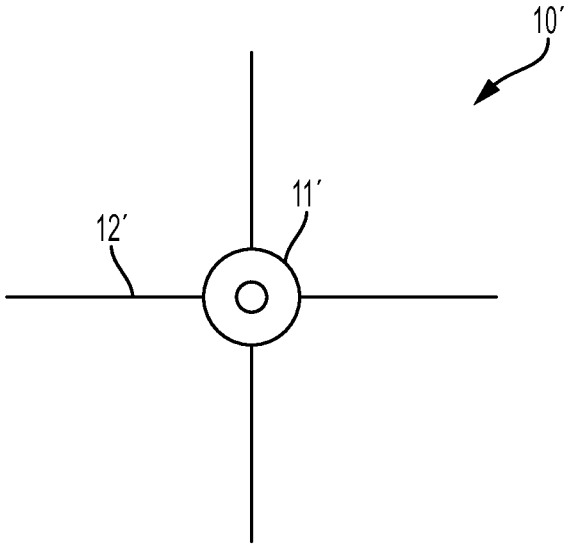
FIG. 5B shows a top plan view of a four leg embodiment of the base of a shoe carousel device built in accordance with a first embodiment of the present invention.

Referring now to FIGS. 5A and 5B, a base 10, 10' of the shoe carousel device may define a base body 11, 11' constructed in a similar manner to the base body illustrated in FIG. 1, having a flat bottom surface and rounded top surface. In this embodiment of the base body 11, 11', however, a plurality of support legs 12, 12' extend outward from the base body 11, 11' with their bottom surface on the same horizontal plane as the bottom surface of the base body 11, 11'. Thus, the support legs 12, 12' provide additional stability to the shoe carousel device by broadening its base structure.

Figure 6:
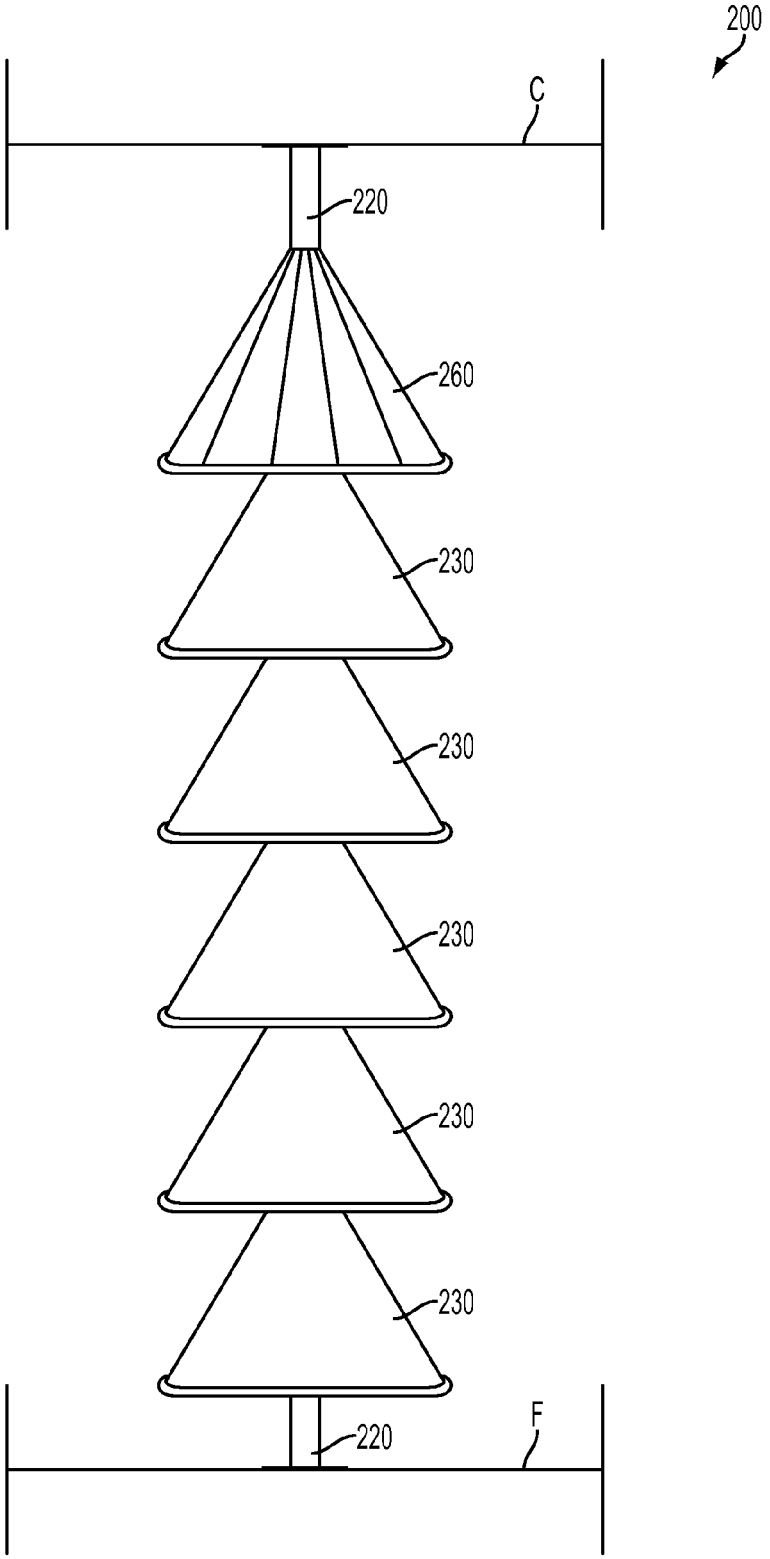
FIG. 6 is a front elevational view of a shoe carousel device built in accordance with a second embodiment of the present invention.

Referring now to FIG. 6, a fixed embodiment of a shoe carousel device 200 is defined by a mounted support stem 220 that is mounted into the floor F and the ceiling C, extending vertically therebetween. As with the moveable embodiment, the shoe carousel device 200 additionally includes a plurality of stackable shelves 230 and a top shelf 260 having the same structural components as the stackable shelves and top shelf illustrated in FIGS. 1-3 for holding shoes in an angled orientation, disposed radially relative to the mounted support stem 220. It is contemplated that in a manual version of the shoe carousel device 200, the stackable shelves 230 and top shelf 260 are mounted on the mounted support stem 220 such that they spin freely. In an alternative, electrical version, the stackable shelves 230 and top shelf 260 are attached to the mounted support stem 220 as with the electrical movable embodiment illustrated in FIGS. 1-3, and also include electrical rope light disposed underneath as with the electrical movable embodiment. In such an electrical version, it is contemplated that an electric motor would be disposed inside the mounted support stem 220 and would be electrically connected to the electrical system of the building, operated by a conventional light style switch.

Figure 7:
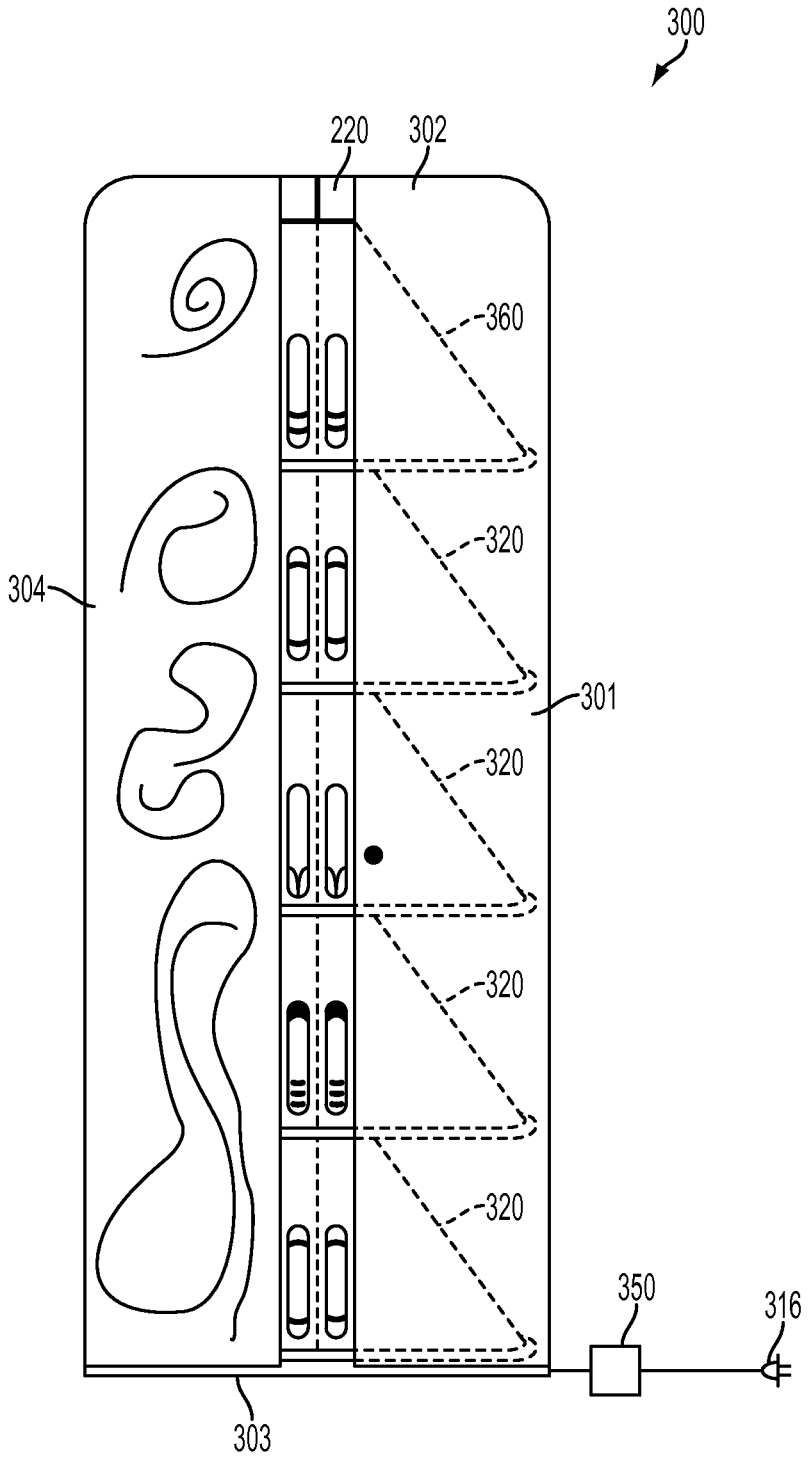
FIG. 7 is a front elevational view of a shoe carousel device built in accordance with a third embodiment of the present invention.

Referring now to FIG. 7, an enclosure embodiment of a shoe carousel device 300 is defined by a circular enclosure 301 having a top portion 302, a bottom portion 303, and a static side wall 304 that extends around most of the circular enclosure 301, leaving an opening sized width wise to enable a pair of shoes to be viewed. A enclosure support stem 320 is mounted into the top portion 302 and bottom portion 303, extending vertically therebetween.

It is contemplated that in some embodiments, the side wall 304 may define two discrete structures, with one or both being movable by sliding or hinge, or removable, to enable shoes to be viewed, retrieved and replaced.

As with the moveable embodiment, the shoe carousel device 300 additionally includes a plurality of stackable shelves 330 and a top shelf 360 having the same structural components as the stackable shelves and top shelf illustrated in FIGS. 1-3 for holding shoes in an angled orientation, disposed radially relative to the enclosure support stem 320. The enclosure embodiment of the shoe carousel device 300 is electrically operated, with the stackable shelves 330 and top shelf 360 attached to the enclosure support stem 320 as with the electrical movable embodiment illustrated in FIGS. 1-3, and also include electrical rope light disposed underneath as with the electrical movable embodiment. It is appreciated that an electric motor (not shown) is disposed inside the enclosure support stem 320 and electrically connected to a foot pedal 350 and electrical plug 316 thereby allowing it and the rope lights to be selectively provided with the electrical power required to facilitate their rotation and illumination operations, respectively.

It is contemplated that the shoe carousel device 300 may additionally or alternative include a battery compartment for use as an electrical power source.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A shoe carousel device, comprising:

a base adapted to support the shoe carousel device and having a top, wherein said base includes a plurality of support legs extending outward therefrom, said support legs configured to provide additional stability by broadening the base laterally;

a support stem with an end, the support stem is attached at a 90 degree angle to the top of the base and extends upward; and a plurality of stackable shelves each with a circumference, the stackable shelves each include a raised outer rim and a surfacing, the stackable shelves are disposed on the support stem;

a top shelf with a top surfacing, wherein the top shelf has a plurality of contiguous angled slats disposed on the top surfacing of the top shelf, the angled slats facilitate keeping one or more flat soled shoes on the top shelf;

an electrical powered motor disposed in said base and connected to a power source and a manual actuator, wherein said motor is operative to rotate the shoe carousel device when the manual actuator is actuated; and an elongated rope light disposed underneath each of the stackable shelves and the top shelf, wherein the elongated rope light illuminates when the manual actuator is actuated to provide lighting to the one or more shoes below each of the stackable shelves and the top shelf.

2. The shoe carousel device of claim 1, wherein the manual actuator is a foot pedal.

3. The shoe carousel device of claim 1, wherein the plurality of stackable shelves and the top shelf are mounted on the support stem such that the plurality of stackable shelves spin freely.

4. The shoe carousel device of claim 1, wherein the plurality of stackable shelves and the top shelf are mounted on the support stem such that when the support stem rotates, the stackable shelves and top shelf rotate with the support stem.

5. The shoe carousel device of claim 1, wherein:

the support stem, stackable shelves, and top shelf are disposed in a discrete circular enclosure having a top portion, a bottom portion, and a static side wall which extends around at least a portion of the support stem, stackable shelves, and top shelf; and the support stem extends vertically between the top portion and the bottom portion.

6. The shoe carousel device of claim 5, wherein the plurality of stackable shelves and the top shelf are mounted on the support stem such that when the support stem rotates, the stackable shelves and top shelf rotate with the support stem.

7. The shoe carousel device of claim 1, wherein the manual actuator is a light switch.

8. The shoe carousel device of claim 1, wherein the support stem extends vertically between and is attached to a ceiling and a floor.

* * * * *